US007988649B1

(12) United States Patent
Kost

(10) Patent No.: US 7,988,649 B1
(45) Date of Patent: Aug. 2, 2011

(54) THERAPEUTIC MASSAGE SYSTEM

(76) Inventor: Jonathan Kost, Farmington, CT (US)

( * ) Notice: Subject to any disclaimer, the term of this patent is extended or adjusted under 35 U.S.C. 154(b) by 980 days.

(21) Appl. No.: 11/512,562

(22) Filed: Aug. 30, 2006

(51) Int. Cl.
*A61H 1/00* (2006.01)

(52) U.S. Cl. ..... 601/15; 601/21; 601/49; 601/57

(58) Field of Classification Search ..... 601/15, 601/20, 21, 49, 56, 57, 58; 5/636, 655, 655.3, 5/644, 648, 915; 607/2, 3, 148
See application file for complete search history.

(56) References Cited

U.S. PATENT DOCUMENTS 5,771,514 A * 6/1998 Wilhoit ..... 5/644
6,206,475 B1 * 3/2001 Tai ..... 297/452.41
6,493,888 B1 * 12/2002 Salvatini et al. ..... 5/904
6,647,572 B2 * 11/2003 Lee ..... 601/57
2004/0193078 A1 * 9/2004 Flick et al. ..... 601/58
2007/0032752 A1 * 2/2007 Wu ..... 601/57

* cited by examiner

*Primary Examiner* — Quang D Thanh
(74) *Attorney, Agent, or Firm* — Our Pal LLC; Pal Asija; Robert Johnson

(57) ABSTRACT

This invention teaches methods, devices, and systems for spasm control and pain relief in any area of the back. It comprises a plurality of adjustable programmable integrated vibratory, thermal and electrical stimulation contacts, which are strategically and symmetrically co-located in plurality of foam layers and an inflatable pillow to provide balanced relief on either side of the spine in any position from lying down to sitting up.

14 Claims, 6 Drawing Sheets

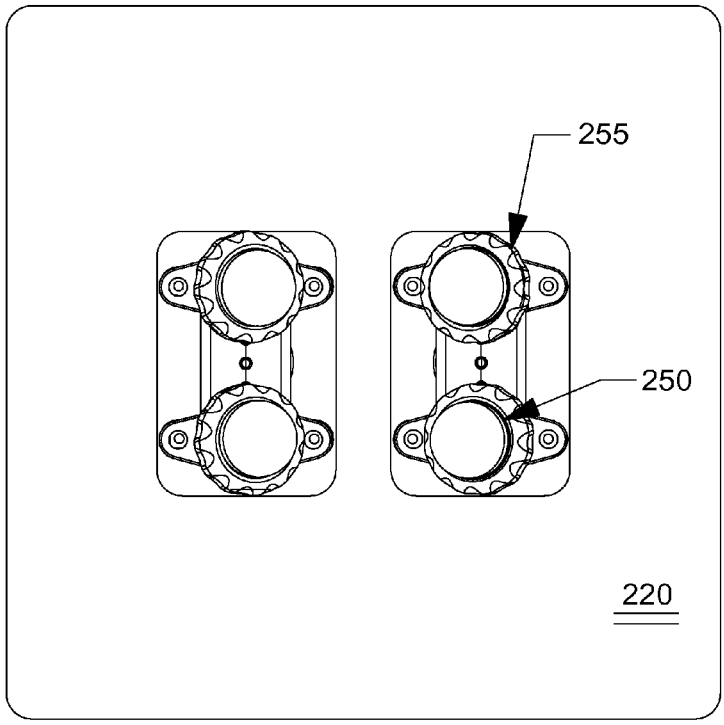
FIG. 2-A
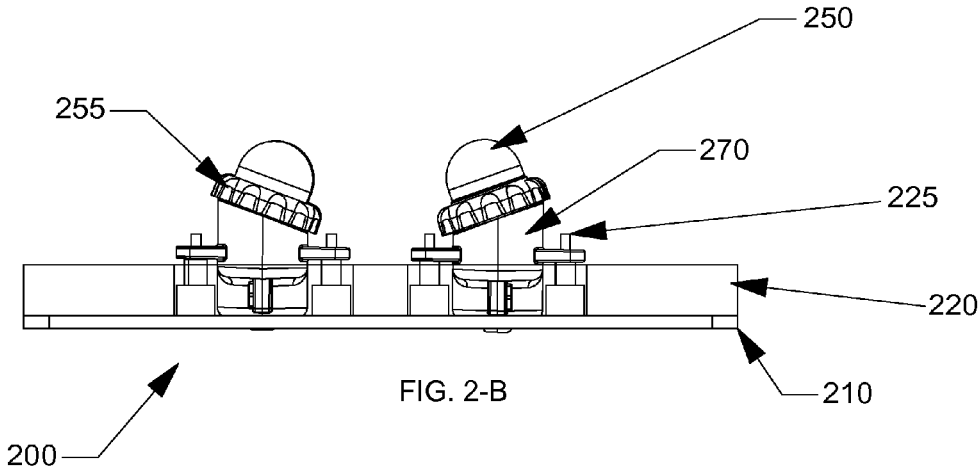
FIG. 2-B

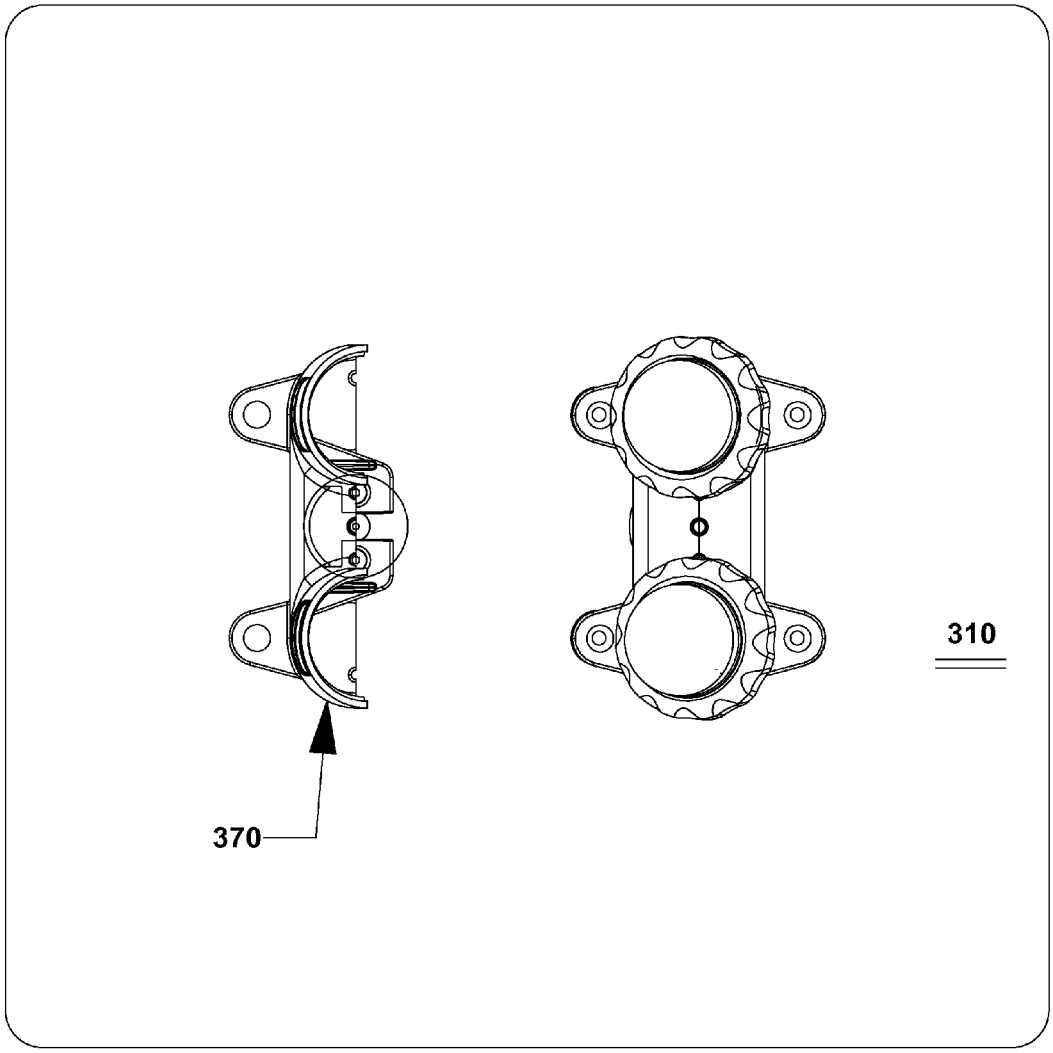
300
FIG. 3-A

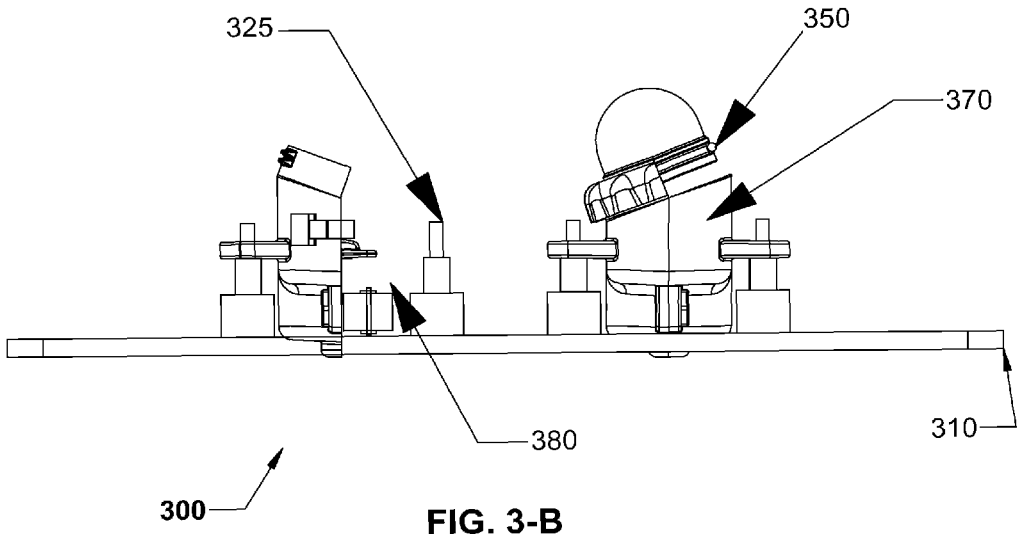
FIG. 3-B

400

THERAPEUTIC MASSAGE SYSTEM

BACKGROUND

This invention relates generally to Self Health Care devices methods and system. More particularly it relates to a Do-It-Yourself novel non-obvious therapeutic massage system. Even more particularly it relates to methods, devices and system for relieving or reducing muscle spasms and concomitant pain thru bicameral variable contact heat, electrical stimulation and vibration sources.

THE PROBLEM

The problem with prior art therapeutic massage systems devices and procedures is that they are neither effective nor affordable. The deficiencies in the prior art systems, devices and methods may be summarized as follows.

a) Not Effective
b) Expensive
c) Not D-I-Y user friendly
d) Not portable
e) Involve complicated FDA approvals
f) Not adjustable to provide customized relief on specific muscles
g) Not comfortable.
h) Non-Intuitive to use
i) Does not provide symmetrical balanced relief for the entire back area.
j) Not reliable having low MTBF
k) Do not provide multiple means of muscle massage combining vibratory, electrical and heat stimulation.

SUMMARY

This invention teaches methods, devices, and systems for spasm control and concomitant pain relief. An embodiment of this massage device comprises plurality of contoured surfaces of the contacting heads for the electrical stimulation component, heat stimulation and vibratory stimulation component to massage the muscle and decrease spasms.

The adjustable vibratory electrical stimulation contacts are strategically and symmetrically co-located in plurality of foam layers and incorporates an inflatable pillow to provide balanced relief on either side of the spine. Right and left sided heat stimulation as well as electrical and vibratory stimulation can all be performed independently. The electrical stimulation utilizes a conductive plastic electrical material at the head of the massager to transmit the electrical impulse to the underlying muscle as opposed to wires and electric pads.

The inventor selected the conductive plastic material for the best mode preferred embodiment to obviate the initial cold feeling that is associated with metal contacts and sensors, because the conductive plastic acts similar to a resistor such that when low voltage electrical signal is applied, the plastic material generates heat for stimulation without the need of an additional heater under the sensor dome heads.

PRIOR ART

A preliminary prior art patent search was not conducted or commissioned by the applicant, but the inventor is intimately familiar with the prior art. There are no known devices that employ an electric muscle stimulation massager without the need of wires and electric pads with a self-adjusting mechanism (pillow height adjustment for variable pressure contact) to adjust contact pressure for comfort and effectiveness.

There are also no other devices that combine the usage of electric muscle stimulation, heat stimulation and vibratory muscle stimulation in one device.

At any rate none of the prior art devices known to the applicant or his attorney disclose the EXACT embodiment of this inventor that constitutes a simple, elegant, quick, convenient, affordable means of spasm control and pain relief in any area of the back. Prior art devices do not provide singularly or even in combination all of the objectives as established by the inventor for this system as enumerated below.

Objectives

1) It is an objective of this invention to provide improved, simplified, time saving, cost effective methods, devices and system for Do-It-Yourself health care.
2) Another objective of this invention is to provide spasm control in any area of the user's back
3) An objective on making the device was to construct it as simple as possible and inexpensive as possible without compromising function and durability.
4) Another objective of this device to be useable by the general public and not fall within the FDA regulatory guidelines of Medical Devices requiring a prescription.
5) Another objective of this invention is to reduce the risk to the user or D-I-Y patient.
6) Another objective of this invention is to promote good health while concurrently reducing cost and the insurance premiums
7) Another objective of this invention is that the design of the device be simple and elegant.
8) Another objective of this invention is that its use is intuitive, which requires no further training beyond what is customary in the profession.
9) Another objective of the system of this invention is that it be capable of multiple uses and multiple situations and circumstances.
10) Another objective of the invention is that it uses minimal additional energy.
11) Another objective of this invention is that the invention use easily interface-able modular standard components.
12) Another objective of this invention is that it be reliable such that it practically never fails.
13) Another objective of this invention is that it be environmentally friendly, and utilize biodegradable materials to the extent practical.
14) Another objective of this invention is that it be physically safe in normal environment as well as accidental situations.
15) Another objective of this invention is to provide a cost effective affordable system for patients and professionals alike.
16) Another objective of this invention is to provide an easy and simple way to manufacture the device of this invention.
17) Another objective of this invention is that it balances convenience and functionality especially for the D-I-Y user.
18) Another objective of this invention is that it obviate the need to meet Federal, State, local, and other private, international, standard guidelines, regulations, compliances and recommendations with respect to safety, environment, and energy consumption
19) Another objective of this invention is that the device may be utilized in the spine in lying down position or in the reclined sitting position.
20) Other objectives of this invention reside in its simplicity, elegance of design, ease of manufacture, service and use and even aesthetics as will become apparent from the following brief description of the drawings and the detailed description of the concept embodiment.

Unfortunately none of the prior art devices singly or even in combination provides all of the features and functionality established by the inventor for this system as enumerated below.

a) Balance between convenience and functionality
b) Safe, Secure, Simple and elegant sleek design
c) Affordable and Cost effective
d) Easy to manufacture, use, operate and maintain.
e) User Friendly and Environmentally friendly.
f) Intuitive to use so as to require no additional training
g) Multiple uses in a wide range of situations and circumstances.
h) Easily scaleable up and down
i) Easily adaptable for other uses
j) Provide multiple means of muscle massage combining vibratory, electrical and heat stimulation.

BRIEF DESCRIPTION OF DRAWINGS

These objectives and features of the invention shall be described in relationship to the following drawings, which are integral part of the specifications and are incorporated herein. Skilled artisan will be able to produce the intended invention with the most efficient dimensions of any of the embodiments contained within this description.

a)

Figure 4:
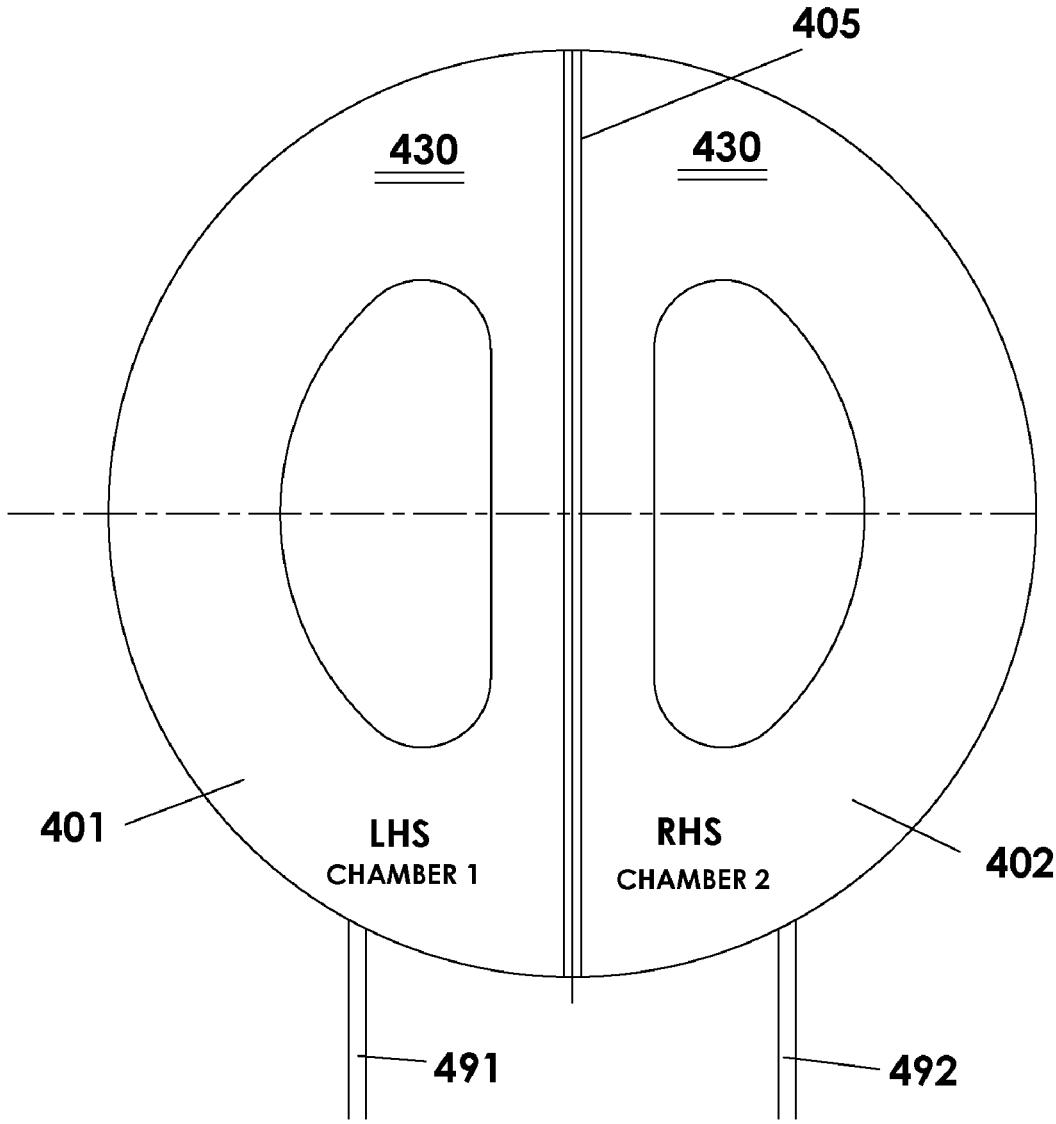
Figure 5:
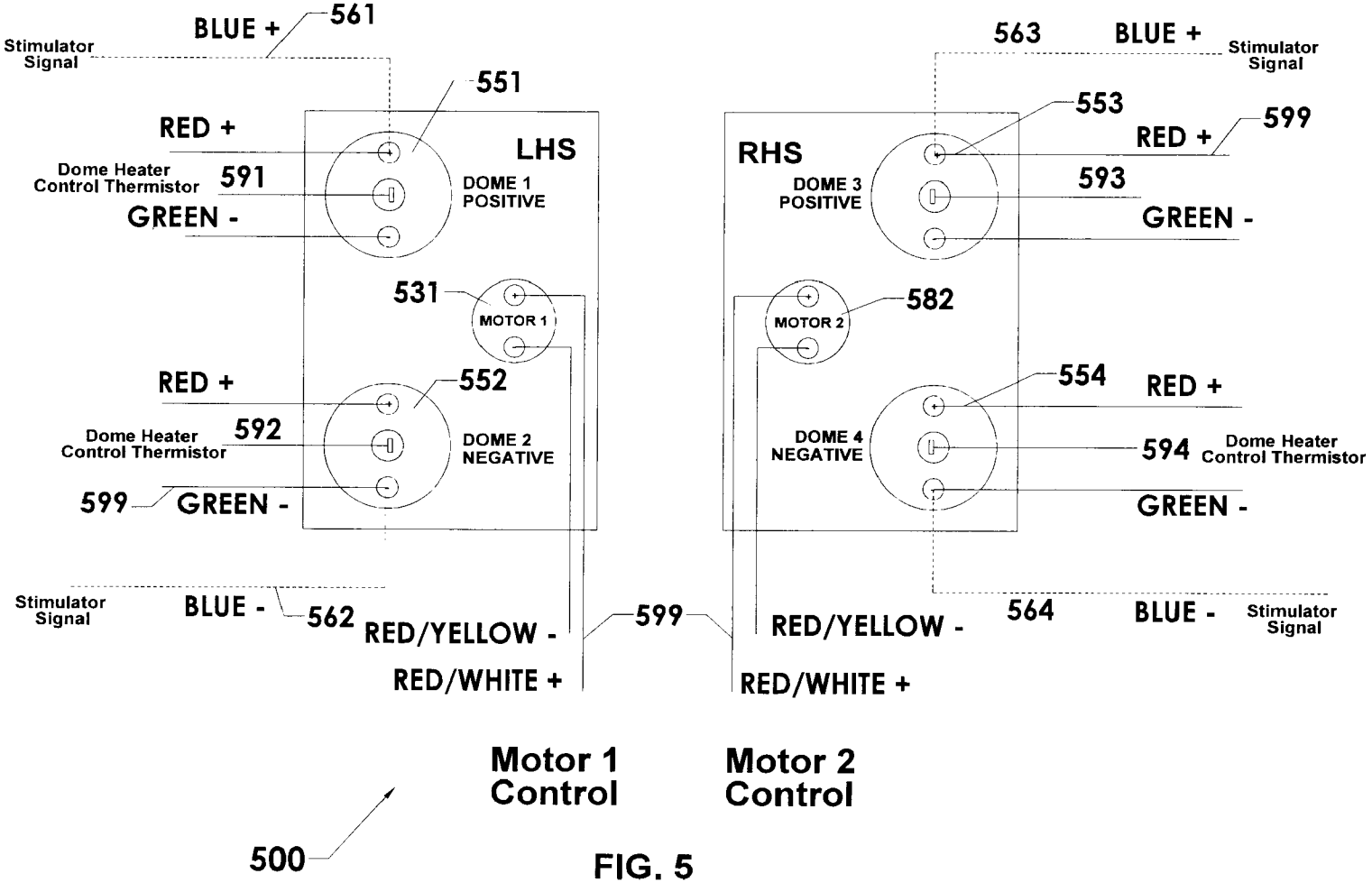

b) FIG. 2-A shows top plan view with top foam layer and inflatable pillow removed.

c) FIG. 2-B is a side elevation thereof again without the top foam layer and the inflatable pillow.

d) FIG. 3-A shows top plan view of the same preferred embodiment with bottom foam layer removed but still showing the base plate on which are mounted the electrical vibratory stimulating contacts wherein further the left pair of stimulating contacts shows half cross section.

e) FIG. 3-B shows side view of the same preferred embodiment with bottom foam layer removed but still showing the base plate on which are mounted the electrical vibratory stimulating contacts wherein further the left pair of stimulating contacts shows half cross section as is the case with FIG. 3-A f) FIG. 4 shows the top plan view of the bi-cameral inflatable pillow of this invention with connections for hand pump for each side of the spine.

g) FIG. 5 shows the electro-mechanical diagram of the vibratory stimulating electrical contact heads or domes as well as motors and other electrical power connections.

DETAILED DESCRIPTION OF THE BEST MODE EMBODIMENT

Figure 1:
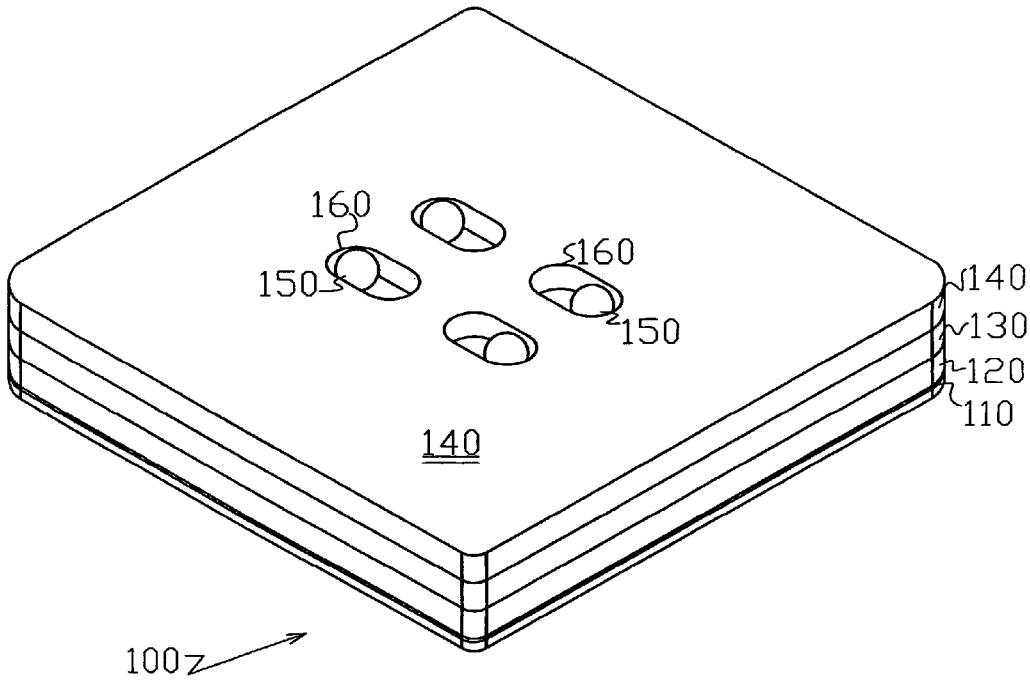
FIG. 1 is a perspective view of an embodiment of therapeutic massage system for control and management of spasms and concomitant pain.

As shown in the drawings wherein like numerals represent like parts throughout the several views, there is generally disclosed in FIG. 1 is a perspective view of an embodiment 100 of therapeutic massage system for control, relief and reduction and management of spasms and concomitant pain complete with base plate 110 for mounting hardware, lower foam layer 120, inflatable pillow layer 130, top or upper foam layer 140, plurality of electrically and thermally conductive vibratory domes 150 which protruding thru openings or housings 160 in top or upper foam layer 140.

The opening 160 is deep enough to go thru inflatable pillow layer 130 as well as bottom or lower foam layer 120. Also shown are plurality of electrically conductive vibratory domes 150 protruding thru openings or housing 160 in top or upper foam layer 140.

FIG. 2-A shows top plan view with bottom or lower foam layer 220 on base plate 210 but inflatable pillow and top foam layer removed. FIG. 2-B is a side elevation thereof again without the top foam layer and the inflatable pillow complete with lower foam layer 220 on base plate 210. Also shown are plurality of electrically conductive vibratory domes 250 in dome housing 270 each with a holding cap 255. Also shown are plurality of vibratory mounts 225.

FIG. 3-A shows top plan view of the same preferred embodiment 300 generally with bottom foam layer 320 also removed but still showing the base plate 310 and dome housing 370.

FIG. 3-B shows side view of the same preferred embodiment with bottom foam layer removed but still showing the base plate 310 on which are mounted the electrical vibratory stimulating contact domes 350 wherein further the left pair of stimulating contacts shows half cross section to expose the motor 380. As in FIG. 2 FIG. 3 also shows plurality of vibratory mounts 325.

FIG. 4 shows the top plan view of the bi-cameral inflatable pillow 430 of this invention having a left hand side chamber 401 and right hand side chamber 402 which can be inflated by hand pumps and deflated thru valve via tubes 491 and 492 respectively. The two chambers LHS 401 and RHS 402 by a heat-sealed vertical barrier longitudinally along the spine of the user.

FIG. 5 shows the electro-mechanical diagram of plurality of vibratory stimulating electrical contact dome heads 551 and 552 on the left hand side chamber and 553 and 554 on the right hand side chamber as well as motors 581 and 582 for left hand and right hand chambers respectively and other electrical power connections 599 complete with dome heater control thermisters 591 & 592 for the left hand side chamber and 593 & 594 for the right hand side chamber as well as stimulator signals 562 and 564 for left and right chambers respectively.

Assembly Use and Opporation

This massage device comprises a plurality of adjustable vibratory electrical stimulation contact domes 150, 250 etc., which are strategically and symmetrically co-located in plurality of foam layers 120, 140 and an inflatable pillow 130 to provide balanced relief on either side of the spine. It utilizes the surface of the contacting heads 150, 350, etc., for the electrical stimulation component, heat stimulation and vibratory stimulation component to massage the muscle and decrease spasms. Right and left sided stimulation as well as electrical and vibratory stimulation can all be performed independently. The electrical stimulation utilizes a conductive electrical material at the head of the massager to transmit the electrical impulse to the underlying muscle as opposed to wires and electric pads.

The electrical stimulating output to the muscle is altered by an electrical rheostat. The muscle is contracted through the contact of the conducting heads of the unit to the skin overlying the muscles being stimulated.

An adequate electric stimulation to the back muscles (within a safe range) is adjusted by the individual in an effort to cause contraction of the muscle. An alternating electrical stimulation and relaxation of the muscles is administered by the device.

A timer built into the device is set by the individual to a predetermined treatment time. One may also utilize the vibratory stimulating massage component by once again either lying on the device or sitting up against it. A vibrating motor situated within the right and left sides of the device vibrate the heads on that side of the device.

The intensity of the vibration to the heads is regulated via a rheostat, a potentiometer or a variable resistor or the equivalent. The left and right sides may be used independently or together. The inflation or deflation of the pillow surrounding the vibrating heads alters the penetrating pressure of the heads as one is either lying down on the device or sitting up against it (as the distance between the contact surface of the head and the pillow is altered).

The timer on the device is preset to a predetermined time for the vibratory massage may be performed. There is also a second rheostat, potentiometer or variable resistor to control the temperature (with safe parameters) of the contact heads. The device may be used in any region of the back (upper, mid & lower) as well as the back of the neck. The left and right sides may be used independently or together.

The massage device possesses two primary functions that help to reduce muscle spasms and therefore pains. It may be used at any region on the back. The electric muscle stimulator function utilizes two contact heads on the left side and two contact heads on the right side. Each side possesses a positive and negative electrical polarity.

The electrical and vibratory massages are self-employed by the individual receiving the massage. An individual simply lies on the device or sits up against it with the massaging heads in contact with the para-spinal muscles (the muscles along the side of the spine). An adjustable strap helps to keep the device at a desired height if one is using the device while sitting in a chair.

One can regulate the intensity of the electrical stimulation to the muscle or regulate the intensity of the vibratory stimulation to the muscle. Variable heat intensity can also be applied independently to the massaging head surfaces of the device and is regulated via a rheostat, potentiometer or variable resistor and is controlled thru thermister feedback to the microprocessor.

The electrical stimulation of the muscle, vibratory stimulation of the muscle and warming of the muscle all are associated with increasing blood flow to the muscle resulting in a decreased spastic state within the muscle. This in turn results in deceased pain in that affected region of the back. The level of pressure being exerted by the massaging heads to the back is controlled by the individual using the device by simply inflating the pneumatic pillows (right and left sided pillows). One can inflate or deflate the pillows while lying or sitting against the device by simply using a hand held pump (or releasing the air). Alternatively a small compressor may be incorporated to automatically inflate or deflate the pillow, much like a blood pressure machine cuff is inflated and deflated by pressing a momentary up/down pressure switch. This inflation or deflation of the pillow changes the elevation of the pillow, causing the massaging head protrusion height to decrease or increase, which in turn results in less or more penetrating pressure to the back muscles.

This variable penetration provides an ability to accommodate to different size individuals, optimizing comfort and effectiveness of the device. The ability to apply pressure to the muscle by the electric stimulating heads improves the electric muscle stimulation effect on the muscle by decreasing the distance from the skin to the muscle. This is accomplished due to the pushing inward on the underlying fatty tissue by the device, which decreases the distance from the skin to the underlying muscle. The decreased distance improves the electrical stimulation of the muscle (due to the decreased resistance).

The typical device where there is an application of electrodes to the skin does not accomplish this. Electrical stimulation may be applied to either side independently or together. The massaging heads on both sides are situated parallel to the para-spinal muscles (muscles along the side of the spine). The electric stimulation of the left and/or right sided muscles is accomplished by the contact heads (two heads on the left and right side) making contact with the skin over laying the para-spinal muscles being stimulated.

The pressure being exerted by the massaging heads is adjusted by the amount of pillow inflation (the pillow surrounding the massaging heads). The individual may either lie on the pillow/massaging device or sit up against it. The amount of pressure exerted by the massaging heads is controlled by the amount of pillow inflation or deflation. The inflation/deflation of the pillow is performed by the individual utilizing a hand pump or alternatively an electric pump may be employed, such that pressing a momentary up/down button controls the small electrical compressor pump.

The assembly and use of this invention is intuitive. Nonetheless the inventor recommends the following steps:

a) mounting a plurality of integrated symmetrically arranged electrically conductive programmable stimulating vibratory dome heads on a base plate;
b) attaching an inflatable pillow sandwiched between two layers of soft materials above said base plate around said plurality of integrated symmetrically arranged thermally and electrically conductive stimulating and vibratory dome heads;
c) programming said programmable electrical stimulating vibratory dome heads according to desired parameters of time, heat, vibration and pressure;
d) inflating said pillow to desired pressure;
e) positioning said system against the back of the user; and
f) automatically administering the program of said programmable stimulating vibratory dome heads.

The inventor has given a non-limiting description of the system of this invention. Due to the simplicity and elegance of the design of this invention designing around it is difficult. Nonetheless many changes may be made to this design without deviating from the spirit of this invention. Examples of such contemplated variations include the following:

a) The range of adjustability of stimulating heads (for example height of heads, distance between the head adjustment—distance between the right and left sides) may be varied.
b) The distance between the stimulating heads (distance between the positive and negative poles of stimulation) may be altered.
c) Different electrical stimulating programs that may offer modified types of electrical stimulation (pulse width, amplitude, sequence of stimulation) may be incorporated, without deviating from the spirit of this invention.
d) Changes in pillow design or change in method of altering height/penetration of stimulating head may be incorporated.
e) Type of vibration of heads (heads that move vertically up and down, i.e.—shiatsu type of massage) may be modified
f) Power source such as Battery vs. AC/DC current operation may be further optimized.
g) Instead of using the carbon doped plastic, change may be made to the composition of stimulating head material.
h) The number of heads contacting with the back muscles may be increased or decrease for example 4 or more on each side as opposed to 2 on each side as used by the inventor in the best mode preferred embodiment.

i) Changes may be made to the in strapping or other adhering device to chair.
j) The color, aesthetics and materials may be enhanced or varied.
k) Additional complimentary and complementary functions and features may be added.
l) A more economical version and/or size of the device may be adapted.
m) A procedural step may be added, deleted or modified.
n) Instead of the manual hand pump, an automatic electrical pump may be employed to inflate or deflate the pillow in conjunction with a momentary up/down press button.
o) Temperature of stimulating heads may be varied.
p) The single pump may inflate unilaterally one side or bilaterally both sides concurrently.
q) The number of chambers may be increased or decreased.
r) The electrical conductivity may be increased or decreased by use of electrically conductive gel.

Other changes such as aesthetics and substitution of newer materials as they become available, which substantially perform the same function in substantially the same manner with substantially the same result without deviating from the spirit of the invention may be made.

The following is a brief description of the function of the components and procedural steps used in the best mode preferred embodiment for the ready reference of the reader the reference numerals have been arranged in ascending numerical order. The first digit denotes the figure number and the last two digits represent the reference number of the component.

| | |
|---|---|
| 100 = | Embodiment of FIG. 1 generally |
| 110 = | Base plate |
| 120 = | Lower or bottom foam layer |
| 125 = | Vibratory mountings |
| 130 = | Inflatable pillow generally |
| 140 = | Upper or top foam layer |
| 150 = | Electrically conductive vibratory dome heads |
| 155 = | Dome positioning caps |
| 160 = | Housing for domes 150 |
| 200 = | Embodiment of FIG. 2 generally |
| 210 = | Base plate |
| 220 = | Lower or bottom foam layer |
| 225 = | Vibratory mountings |
| 230 = | Inflatable pillow generally |
| 240 = | Upper or top foam layer |
| 250 = | Electrically conductive vibratory dome heads |
| 255 = | Dome positioning caps |
| 300 = | Embodiment of FIG. 3 generally |
| 310 = | Base plate |
| 320 = | Lower or bottom foam layer |
| 325 = | Vibratory mountings |
| 330 = | Inflatable pillow generally |
| 340 = | Upper or top foam layer |
| 350 = | Electrically conductive vibratory dome heads |
| 355 = | Dome positioning caps |
| 370 = | Dome housing |
| 400 = | Embodiment of FIG. 4 generally |
| 401 = | Left hand side chamber |
| 402 = | Right hand side chamber |
| 405 = | Heat sealed vertical separator |
| 430 = | Inflatable pillow generally |
| 491 = | Left hand side pump interface |
| 492 = | Right hand side pump interface |
| 500 = | Embodiment of FIG. 5 generally |
| 551 = | Left hand side dome-1 |
| 552 = | Left hand side dome-2 |
| 553 = | Right hand side dome-1 |
| 552 = | Right hand side dome-2 |
| 561 = | Left hand side simulator signal-1 |
| 562 = | Left hand side simulator signal-2 |
| 563 = | Right hand side simulator signal-1 |

-continued

| | |
|---|---|
| 564 = | Right hand side simulator signal-2 |
| 581 = | Left hand side motor |
| 582 = | Right hand side motor |
| 599 = | Power connections |

DEFINITIONS AND ACRONYMS

A great care has been taken to use words with their conventional dictionary definitions. Following definitions are included here for clarification.

| | |
|---|---|
| 3D = | Three Dimensional |
| DIY = | Do It Yourself |
| FDA = | Food and Drug Administration of the United States Executive Branch. |
| Integrated = | Combination of two entities to act like one |
| Interface = | Junction between two dissimilar entities |
| LHS = | Left hand side |
| RHS = | Right hand side |
| MTBF = | Mean Time Between Failure |
| Symmetrical = | Mirror image along any axis. |

While this invention has been described with reference to illustrative embodiments, this description is not intended to be construed in a limiting sense. Various modifications and combinations of the illustrative embodiments as well as other embodiments of the invention will be apparent to a person of average skill in the art upon reference to this description. It is therefore contemplated that the appended claim(s) cover any such modifications, embodiments as fall within the true scope of this invention.

The invention claimed is:

1. A therapeutic method of back muscle spasm and concomitant pain management for a back of a user, the method comprising the steps of:

a) providing a system by mounting a plurality of integrated symmetrically arranged electrically conductive programmable stimulating vibratory dome heads on a base plate of said system;
b) attaching an inflatable pillow sandwiched between two layers of soft materials above said base plate around said plurality of integrated symmetrically arranged electrically conductive stimulating vibratory dome heads;
c) programming a program of said programmable stimulating vibratory dome heads, said program including selectable parameters according to duration, heat intensity, electrical stimulation intensity, vibration intensity and pressure intensity;
d) selecting the parameters of duration, heat intensity, electrical stimulation intensity and vibratory intensity;
e) inflating said pillow to desired pressure;
f) positioning said system against the back of the user in position from lying down to sitting; and
g) automatically administering the program of said programmable stimulating vibratory dome heads.

2. The therapeutic method of back muscle spasm and concomitant pain management and control system of claim 1 wherein said inflatable pillow is divided into two chambers each with said plurality of integrated electrically conductive stimulating vibratory dome heads and each chamber having its own motor, electrical controls and means of inflating and deflating said pillow sandwiched between said pair of soft material layers.

3. The therapeutic method of back muscle spasm and concomitant pain management of claim 2 wherein said two chambers of inflatable pillow are separated by a sealed vertical separation member.

4. The therapeutic method of back muscle spasm and concomitant pain management of claim 2 wherein said plurality of integrated electrically conductive stimulating vibratory dome heads in each said chamber are two.

5. The therapeutic method of back muscle spasm and concomitant pain management of claim 3 for a self help user wherein said plurality of integrated electrically conductive stimulating vibratory dome heads in each said chamber are situated parallel to the para-spinal muscles of the user when said sealed vertical separation member is aligned with the spine of the self-help user.

6. The therapeutic method of back muscle spasm and concomitant pain management and control system of claim 1 wherein said parameter of said duration is from 5 to 30 minutes of alternating stimulation and relaxation of muscles.

7. A therapeutic massage system for pain and muscle spasm control and management and relief comprising plurality of integrated electrically conductive stimulating vibratory dome heads embedded in an inflatable pillow sandwiched between a pair of flat, soft materials and wherein said inflatable pillow is divided into two chambers each with said plurality of integrated electrically conductive stimulating vibratory dome heads and each chamber having its own motor, electrical controls and means of inflating and deflating said pillow sandwiched between said pair of flat soft materials.

8. The therapeutic massage system of claim 7 wherein said two chambers of inflatable pillow are separated by a sealed vertical separation member.

9. The therapeutic massage system of claim 7 wherein said plurality of integrated electrically conductive stimulating vibratory dome heads in each said chamber are two.

10. The therapeutic massage system of claim 8 for a self help user having a spine wherein said plurality of integrated electrically conductive stimulating vibratory dome heads in each said chamber are situated parallel to the para-spinal muscles of the user when said sealed vertical separation member is aligned with the spine of the self-help user.

11. A back muscle spasm and concomitant pain management and control system comprising:

a) a base plate;

b) plurality of integrated programmable electrically conductive stimulating vibratory dome heads mounted on said base plate;

c) a first soft material layer around said plurality of integrated electrically conductive stimulating vibratory dome heads mounted on said base plate;

d) an inflatable pillow above said first soft material layer;

e) a second soft material layer around said plurality of integrated electrically conductive stimulating vibratory dome heads above said first soft material layer so as to sandwich said inflatable pillow between two said first and second soft material layers;

f) said inflatable pillow is divided into two chambers each with said plurality of integrated electrically conductive stimulating vibratory dome heads; and g) each said chamber having its own motor, electrical controls and means of inflating and deflating said pillow sandwiched between said pair of soft material layers.

12. The back muscle spasm and concomitant pain management and control system of claim 11 wherein said two chambers of inflatable pillow are separated by a sealed vertical separation member.

13. The back muscle spasm and concomitant pain management and control system of claim 11 wherein said plurality of integrated electrically conductive stimulating vibratory dome heads in each said chamber are two.

14. The back muscle spasm and concomitant pain management and control system of claim 12 for a self help user having a spine wherein said plurality of integrated electrically conductive stimulating vibratory dome heads in each said chamber are situated parallel to the para-spinal muscles of the user when said sealed vertical separation member is aligned with the spine of the self-help user.

* * * * *